US009311860B2

(12) United States Patent
Campbell et al.

(10) Patent No.: US 9,311,860 B2
(45) Date of Patent: Apr. 12, 2016

(54) LIQUID CRYSTAL DISPLAY USING BACKLIGHT INTENSITY TO COMPENSATE FOR PIXEL DAMAGE

(71) Applicant: Lenovo Enterprise Solutions (Singapore) Pte. Ltd., Singapore (SG)

(72) Inventors: Keith M. Campbell, Cary, NC (US); William M. Megarity, Raleigh, NC (US); Luke D. Remis, Raleigh, NC (US); Gregory D. Sellman, Morrisville, NC (US); Christopher L. Wood, Greenville, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 202 days.

(21) Appl. No.: 14/019,923

(22) Filed: Sep. 6, 2013

(65) Prior Publication Data

US 2015/0070257 A1 Mar. 12, 2015

(51) Int. Cl.

| | |
|---|---|
| ***G09G 3/36*** | (2006.01) |
| ***G09G 3/34*** | (2006.01) |
| ***G09G 3/00*** | (2006.01) |

(52) U.S. Cl.

CPC ..... *G09G 3/3406* (2013.01); *G09G 3/006* (2013.01); *G09G 3/3611* (2013.01); *G09G 3/3648* (2013.01); *G09G 2320/0285* (2013.01); *G09G 2360/147* (2013.01)

(58) Field of Classification Search

None

See application file for complete search history.

(56) References Cited

U.S. PATENT DOCUMENTS

| | | | |
|---|---|---|---|
| 4,655,552 | A | 4/1987 | Togashi et al. |
| 6,028,581 | A | 2/2000 | Umeya |
| 7,816,684 | B2 | 10/2010 | Choi |
| 7,829,920 | B2 | 11/2010 | Cho et al. |
| 8,143,090 | B2 | 3/2012 | Weng et al. |

(Continued)

FOREIGN PATENT DOCUMENTS

| | | | |
|---|---|---|---|
| JP | 2012133797 | A | 7/2012 |
| JP | 2012234474A | A | 11/2012 |
| WO | WO2008047736 | A1 | 4/2008 |

OTHER PUBLICATIONS

Abileah, Adi et al., "Optical Sensors Embedded within AMLCD Panel: Design and Applications", Planar Systems, Beaverton, OR, USA, SIGGRAPH conference Aug. 5-9, 2007, 5 pages.

(Continued)

*Primary Examiner* — Adam R Giesy
*Assistant Examiner* — Henok Heyi
(74) *Attorney, Agent, or Firm* — Katherine S. Brown; Jeffrey L. Streets

(57) ABSTRACT

A computer program product (CPP) for controlling a liquid crystal display (LCD) includes code for applying a test voltage to each liquid crystal element (LCE) disposed in an addressable array forming the LCD, and code for detecting an amount of light received by photosensors while applying the test voltage to the LCEs, wherein each photosensor is aligned behind and logically associated with one of the LCEs. The CPP further includes code for applying selected voltage levels to each LCE to display an image, and code for controlling an amount of backlight produced by backlighting elements in an addressable array while the image is displayed. Each backlighting element is aligned behind and logically associated with one LCE, and at least one backlighting element is controlled to compensate for a difference between the amount of light detected by the photosensor logically associated with at least one LCE and the other photosensors.

20 Claims, 6 Drawing Sheets

(56) References Cited

U.S. PATENT DOCUMENTS

| | | | | |
|---|---|---|---|---|
| 8,154,532 | B2 | 4/2012 | Chou et al. | |
| 2008/0030725 | A1 | 2/2008 | Hachisuka | |
| 2008/0036715 | A1* | 2/2008 | Lee et al. | 345/87 |
| 2008/0225196 | A1 | 9/2008 | Kim | |
| 2008/0239114 | A1 | 10/2008 | Shin et al. | |
| 2008/0297487 | A1 | 12/2008 | Hotelling et al. | |
| 2010/0052713 | A1* | 3/2010 | Kunimori et al. | 324/754 |
| 2010/0060562 | A1* | 3/2010 | Hadwen et al. | 345/102 |
| 2010/0090996 | A1 | 4/2010 | Chou et al. | |
| 2011/0027918 | A1* | 2/2011 | Tanaka | 438/16 |
| 2011/0310342 | A1* | 12/2011 | Kim et al. | 349/149 |
| 2012/0002147 | A1 | 1/2012 | Umeno | |
| 2012/0154331 | A1 | 6/2012 | Hasui | |
| 2012/0182225 | A1 | 7/2012 | Brosnan | |
| 2012/0200531 | A1 | 8/2012 | Araki | |

OTHER PUBLICATIONS

Jin Kwan Kim et al. "A photo-sensor on thin polysilicon membrane embedded in wafer level package LED", SPIE Digital Library, vol. 8431, Proc. SPIE 8431, Silicon Photonics and Photonic Integrated Circuits III, 843121 (Jun. 1, 2012); doi:10.1117/12.921623.

Sungjoo Suh et al., "Mobile LCD Device with Tran sparent Infrared Image Sensor Panel for Touch and Hover Sensing", 2012 IEEE International Conference on Consumer Electronics (ICCE), 2 pages. (This document only identifies the year of publication (without the month), but the year of publication is sufficiently earlier than the effective U.S. filing date and any foreign priority date so that the particular month of publication is not in issue. See MPEP 609.04(a)).

* cited by examiner

90

Backlight Compensation Table

| Pixel Address | Compensation |
|---|---|
| E1 | +10% |
| F1 | +10% |
| G1–2 | +10% |
| H1–2 | +10% |
| I1–2 | +10% |
| J1 | +20% |
| J2–3 | +10% |
| ⋮ | ⋮ |

LIQUID CRYSTAL DISPLAY USING BACKLIGHT INTENSITY TO COMPENSATE FOR PIXEL DAMAGE

BACKGROUND

1. Field of the Invention

The present invention relates to liquid crystal displays (LCD), and methods of controlling the LCD to display images.

2. Background of the Related Art

Liquid Crystal Displays (LCDs) have developed significantly and become widely used due to their characteristic light weight, thin shape and low power consumption. Many of today's electronic devices include an LCD, including television screens, computer monitors, notebook computers, and mobile telephones. Some of these devices may even include more than one LCD panel or screen.

LCD screens may incorporate various technologies, but they are based upon a layer of liquid crystals disposed between two transparent electrodes and two polarizing filters. The liquid crystal molecules have a first orientation in the absence of an electric field and are induced into a second orientation upon application of an electric field between the electrodes. The difference in light polarization of the liquid crystals between the first and second orientations is used in combination with the polarizing filters such that control over the electric field determines whether, or to what extent, light will pass through the liquid crystal layer. By arranging large numbers of liquid crystal elements or "pixels" into a two-dimensional array, it is possible to apply the electrical field to selected pixels in order to display images.

However, if any of the pixels are subject to the same electric field over a long period of time, ionic compounds in the liquid crystal layer can build up on one of the electrodes and degrade performance of that particular pixel. Other mechanisms may similarly degrade the LCD pixel such that light transmission through the pixel is affected.

BRIEF SUMMARY

One embodiment of the present invention provides a method of controlling a liquid crystal display. The method comprises applying a test voltage to each of a plurality of liquid crystal elements disposed in an addressable array forming the liquid crystal display, and detecting an amount of light received at each of a plurality of photosensors while the test voltage is being applied to the plurality of liquid crystal elements, wherein each one of the photosensors is aligned behind one of the liquid crystal elements receiving the test voltage and is logically associated with the aligned liquid crystal element. The method further comprises applying selected voltage levels to each of the plurality of liquid crystal elements in order to display an image, and controlling an amount of backlight produced by each of a plurality of backlighting elements in an addressable array while the image is being displayed. Each of the backlighting elements is aligned behind one of the liquid crystal elements and is logically associated with the aligned liquid crystal element. Furthermore, for at least one of the liquid crystal elements, the amount of backlight produced by the backlighting elements logically associated with the at least one of the liquid crystal elements is controlled to compensate for a difference between the amount of light detected by the photosensor logically associated with the at least one of the liquid crystal elements and the amount of light detected by other photosensors of the plurality of photosensors.

Another embodiment of the present invention provides a computer program product including computer usable program code embodied on a computer readable storage medium for controlling a liquid crystal display. The computer program product includes computer usable program code for applying a test voltage to each of a plurality of liquid crystal elements disposed in an addressable array forming the liquid crystal display; computer usable program code for detecting an amount of light received at each of a plurality of photosensors while the test voltage is being applied to the plurality of liquid crystal elements, wherein each one of the photosensors is aligned behind one of the liquid crystal elements receiving the test voltage and is logically associated with the aligned liquid crystal element; computer usable program code for applying selected voltage levels to each of the plurality of liquid crystal elements in order to display an image; and computer usable program code for controlling an amount of backlight produced by each of a plurality of backlighting elements in an addressable array while the image is being displayed, wherein each of the backlighting elements is aligned behind one of the liquid crystal elements and is logically associated with the aligned liquid crystal element, and wherein, for at least one of the liquid crystal elements, the amount of backlight produced by the backlighting elements logically associated with the at least one of the liquid crystal elements is controlled to compensate for a difference between the amount of light detected by the photosensor logically associated with the at least one of the liquid crystal elements and the amount of light detected by other photo sensors of the plurality of photosensors.

DETAILED DESCRIPTION

Figure 1:
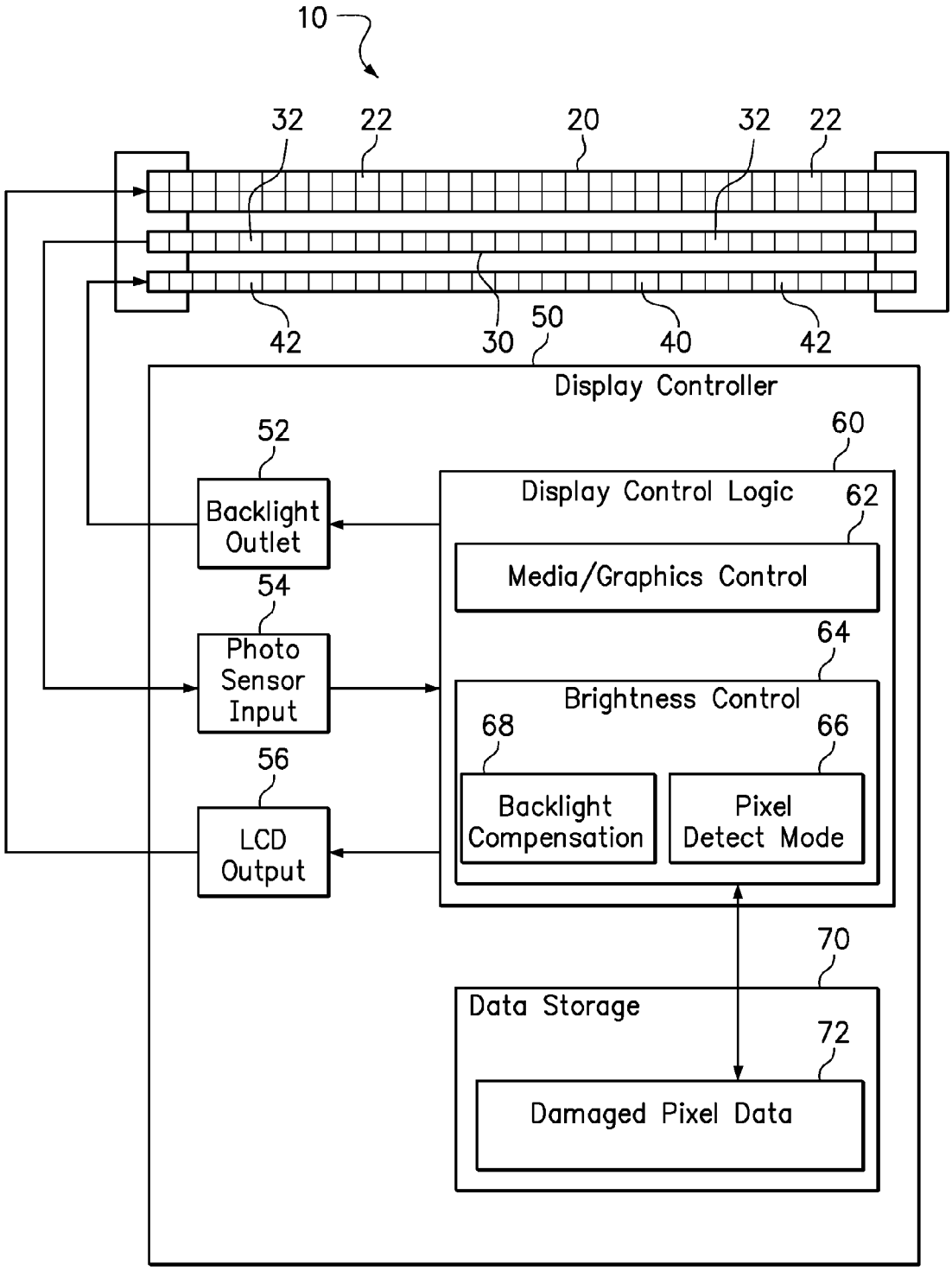
FIG. 1 is a diagram of a liquid crystal display system.

One embodiment of the present invention provides a method of controlling a liquid crystal display. The method comprises applying a test voltage to each of a plurality of liquid crystal elements disposed in an addressable array forming the liquid crystal display, and detecting an amount of light received at each of a plurality of photosensors while the test voltage is being applied to the plurality of liquid crystal elements, wherein each one of the photosensors is aligned behind one of the liquid crystal elements receiving the test voltage and is logically associated with the aligned liquid crystal element. The method further comprises applying selected voltage levels to each of the plurality of liquid crystal elements in order to display an image, and controlling an amount of backlight produced by each of a plurality of backlighting elements in an addressable array while the image is being displayed. Each of the backlighting elements is aligned behind one of the liquid crystal elements and is logically associated with the aligned liquid crystal element. Furthermore, for at least one of the liquid crystal elements, the amount of backlight produced by the backlighting elements logically associated with the at least one of the liquid crystal elements is controlled to compensate for a difference between the amount of light detected by the photosensor logically associated with the at least one of the liquid crystal elements and the amount of light detected by other photosensors of the plurality of photosensors.

In another embodiment, the light received at each of a plurality of photosensors while the test voltage is being applied to the plurality of liquid crystal elements is ambient light. Accordingly, the ambient light passes through the plurality of liquid crystal elements to the plurality of photosensors. In a first option, the backlighting elements that are logically associated with the at least one of the liquid crystal elements are controlled to produce less backlight in response to the amount of light detected by the photosensor logically associated with the at least one of the liquid crystal elements being greater than the amount of light detected by other photosensors of the plurality of photosensors. In a second option, the backlighting elements that are logically associated with the at least one of the liquid crystal elements are controlled to produce more backlight in response to the amount of light detected by the photosensor logically associated with the at least one of the liquid crystal elements being less than the amount of light detected by other photosensors of the plurality of photosensors.

In yet another embodiment, the light received at each of a plurality of photosensors while the test voltage is being applied to the plurality of liquid crystal elements is light produced by the plurality of backlighting elements controlled to produce an equal amount of light, wherein the light produced by the plurality of backlighting elements is reflected off the plurality of liquid crystal elements to the plurality of photosensors. In a first option, the backlighting elements that are logically associated with the at least one of the liquid crystal elements are controlled to produce more backlight in response to the amount of light detected by the photosensor logically associated with the at least one of the liquid crystal elements being greater than the amount of light detected by other photosensors of the plurality of photosensors. In a second option, the backlighting elements that are logically associated with the at least one of the liquid crystal elements are controlled to produce less backlight in response to the amount of light detected by the photosensor logically associated with the at least one of the liquid crystal elements being less than the amount of light detected by other photosensors of the plurality of photosensors.

The test voltage may be any one or more voltage within a range of voltages that the liquid crystal elements are designed to handle. The test voltage is preferably is a single fixed voltage. For example, a single fixed voltage may be selected from no voltage and a maximum voltage. Furthermore, the method may use a first test voltage that is fixed at a value that would cause a normal working liquid crystal element to allow all light to pass through, and separately use a second test voltage that is fixed at a value that would cause a normal working liquid crystal element to block all light from passing through. These two test voltages will provide the greatest amount of contrast between a normal working liquid crystal element and a damaged (bad or stuck) liquid crystal element or pixel.

The liquid crystal display system may include any of the various materials and configurations known in the art. As non-limiting examples, the photosensors may be thin film transistors, and the backlighting elements may be light emitting diodes.

Since the condition of the liquid crystal elements may continue to change over time, the methods of the present invention may be periodically repeated. For example, one method may include periodically repeating the steps of applying a test voltage to each of a plurality of liquid crystal elements disposed in an addressable array forming the liquid crystal display, and detecting an amount of light received at each of a plurality of photosensors while the test voltage is being applied to the plurality of liquid crystal elements. The method would then proceed by using the most current light detection data as a basis for controlling the backlighting to compensate for damaged or abnormal pixels.

In a still further embodiment, the backlighting compensation is limited to pixels that pass significantly more light or significantly less light than a normal working liquid crystal element. In one non-limiting example, the amount of backlight produced by the backlighting elements is controlled to compensate for a difference between the amount of light detected by the photosensor logically associated with the at least one of the liquid crystal elements and the amount of light detected by other photosensors of the plurality of photosensors only if the difference exceeds a predetermined setpoint. Optionally, the amount of light detected by all photosensors may be averaged, and the pixels receiving backlight compensation may pass light in an amount that deviates from the average by a predetermined amount.

Another embodiment of the present invention provides a computer program product including computer usable program code embodied on a computer readable storage medium for controlling a liquid crystal display. The computer program product includes computer usable program code for applying a test voltage to each of a plurality of liquid crystal elements disposed in an addressable array forming the liquid crystal display; computer usable program code for detecting an amount of light received at each of a plurality of photosensors while the test voltage is being applied to the plurality of liquid crystal elements, wherein each one of the photosensors is aligned behind one of the liquid crystal elements receiving the test voltage and is logically associated with the aligned liquid crystal element; computer usable program code for applying selected voltage levels to each of the plurality of liquid crystal elements in order to display an image; and computer usable program code for controlling an amount of backlight produced by each of a plurality of backlighting elements in an addressable array while the image is being displayed, wherein each of the backlighting elements is aligned behind one of the liquid crystal elements and is logically associated with the aligned liquid crystal element, and wherein, for at least one of the liquid crystal elements, the amount of backlight produced by the backlighting elements logically associated with the at least one of the liquid crystal elements is controlled to compensate for a difference between the amount of light detected by the photosensor logically associated with the at least one of the liquid crystal elements and the amount of light detected by other photo sensors of the plurality of photosensors.

The foregoing computer program product may further include computer readable program code for implementing or initiating any one or more aspects of the methods described herein. Accordingly, a separate description of the methods will not be duplicated in the context of a computer program product.

FIG. 1 is a diagram of a liquid crystal display (LCD) system 10. The system includes an array of liquid crystal elements (LCD elements) 20, an array of photosensors or photodiodes 30, an array of backlighting elements 40, and a display controller 50. The LCD array 20 includes a plurality of individually addressable LCD elements 22. The LCD array 20 includes a layer of liquid crystals between two transparent plates. While the plates may be continuous sheets, the divisions shown represent pixels that are defined by electrodes secured to the two transparent plates and facing the liquid crystal layer.

The photosensor array 30 includes a plurality of individual photosensors 32 that are each aligned with one of the LCD elements 22. Each photosensor 32 is also logically associated with the LCD element 22 with which it is aligned. The term "logically associated" means that amount of light detected by a given photosensor can be attributed to the performance of the corresponding LCD element. The display controller keeps track of which photosensor signal is logically associated with each LCD element.

The backlighting array 40 includes a plurality of backlighting elements 42 that are also individually addressable so that any one or more of the backlighting elements 42 can be separately controlled to generate more or less light. According to one embodiment of the invention, each pixel of the display may include an LCD element 22, a photosensor 32, and a backlighting element 42 that are all in alignment and logically associated with each other.

The display controller 50 includes one or more backlight output port 52, one or more photosensor input port 54, and one or more LCD output port 56. These ports allows the display controller 50 to communicate with the LCD array 20, photosensor array 30, and backlighting array 40. The display control logic 60 includes a media/graphics control module 62 and a brightness control module 64. In accordance with one or more embodiments of the present invention, the brightness control module 64 may enter a pixel detect mode 66 in order to test the performance of the liquid crystal elements 22 of the LCD array 20. Pixel performance data from the test, including damaged pixel data 72 may be stored in the data storage device 70.

In one embodiment, the pixel detect mode 66 causes the LCD output port 56 to apply a test voltage to each of the plurality of liquid crystal elements 22 disposed in the addressable array 20 forming the liquid crystal display. While the test voltage is being applied to the plurality of liquid crystal elements 22, each of the photosensors 32 detects an amount of light and provides that information to the pixel detect mode 66 through the photosensor input port 54.

In order to display an image on the LCD array 20, the media/graphics control module 62 causes the LCD output port 56 to apply selected voltage levels to each of the plurality of liquid crystal elements 22. While the image is being displayed, a backlight compensation module 68 controls an amount of backlight produced by each of a plurality of backlighting elements 42 in the addressable backlighting array 40. The amount of backlight produced by one of the backlighting elements 42 is based upon the pixel performance data collected by the pixel detect mode 66. For example, for at least one of the liquid crystal elements 22, the amount of backlight produced by the backlighting elements 42 logically associated with the at least one of the liquid crystal elements is controlled to compensate for a difference between the amount of light detected by the photosensor 32 logically associated with the at least one of the liquid crystal elements 22 and the amount of light detected by other photosensors 32 of the photosensor array 30.

Figure 2:
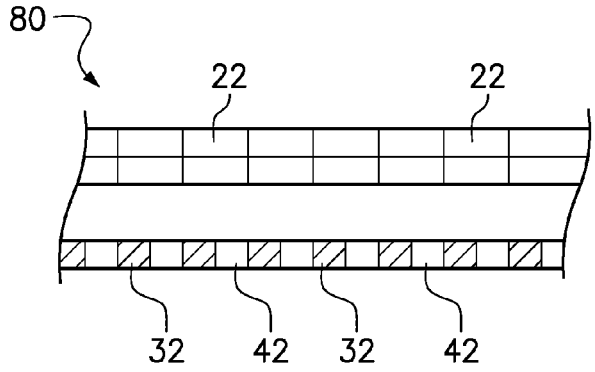
FIG. 2 is a diagram of an alternative liquid crystal display system.

FIG. 2 is a diagram of an alternative liquid crystal display system 80. The system 80 is the same as system 10 of FIG. 1, except that the photosensors 32 (cross-hatched) and the backlighting elements 42 are in the same plane. Note that there is still one photosensor 32 and one backlighting element 42 aligned with each of the LCD elements 22.

Figure 3A:
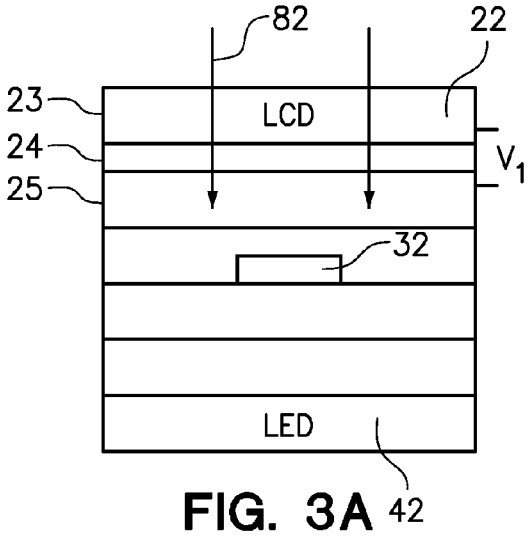
FIGS. 3A and 3B are diagrams of a liquid crystal element, photosensor and backlighting element using ambient light to test the liquid crystal element.
Figure 3B:
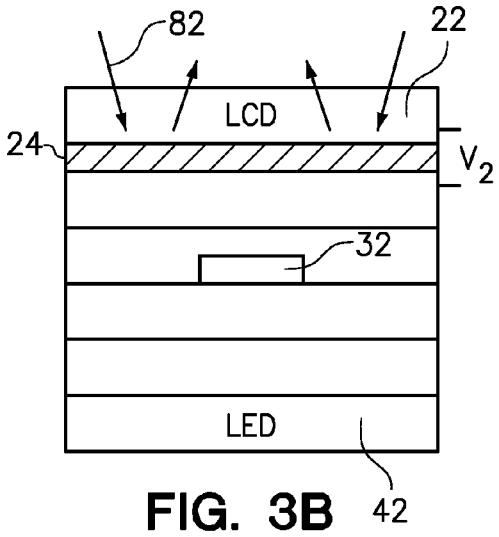

FIGS. 3A and 3B are diagrams of a liquid crystal element 22, photosensor 32 and backlighting element 42 using ambient light 82 to test the liquid crystal element. Referring to FIG. 3A, the ambient light passes through the upper plate 23, the liquid crystal layer 24, and the lower plate 25 to the photosensor 32. At the applied test voltage, $V_1$, the liquid crystal layer 24 (in cooperation with polarizing filters on either side thereof; not shown, but conceptually forming part of the upper and lower plates 23, 25) passes substantially all of the ambient light, such that the photosensor 32 detects a significant amount of light. Referring to FIG. 3B, the applied test voltage, $V_2$, is different than $V_1$, such that the liquid crystal layer 24 (in cooperation with polarizing filters on either side thereof; not shown) reflects most of the ambient light, such that the photosensor detects very little of the ambient light.

Figure 4A:
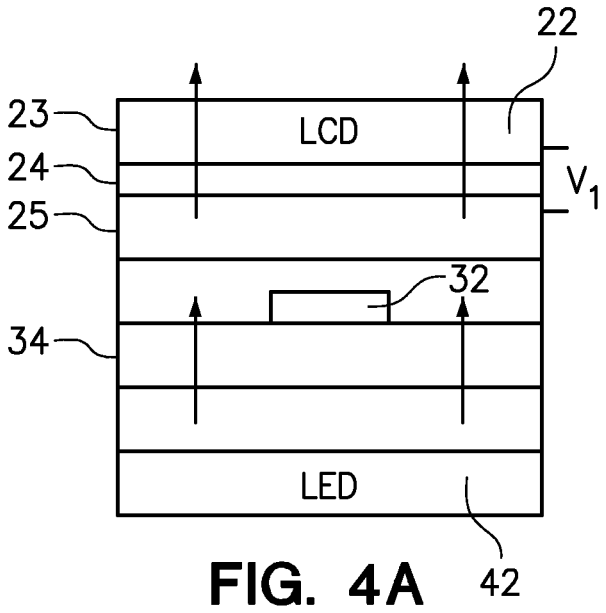
FIGS. 4A and 4B are diagrams of a liquid crystal element, photosensor and backlighting element using reflected backlight to test the liquid crystal element.
Figure 4B:
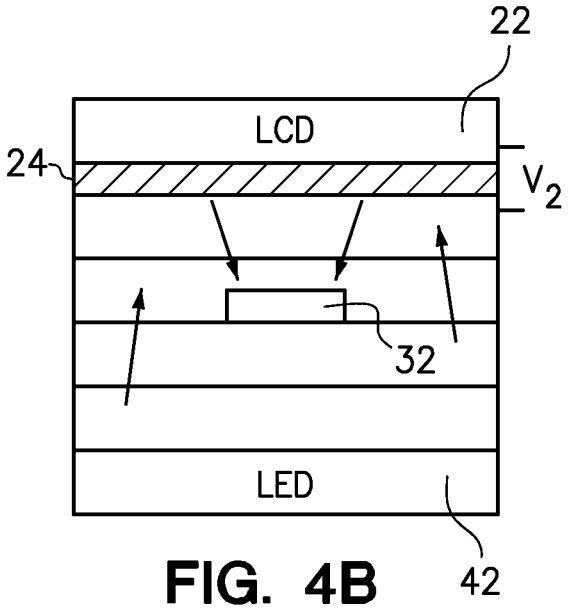

FIGS. 4A and 4B are diagrams of a liquid crystal element 22, photosensor 32 and backlighting element 42 using reflected backlight to test the liquid crystal element. Referring to FIG. 4A, the backlight produces by the backlighting element (LED 42) passes through an transparent support 34 for the photosensor 32, and through the lower plate 25, the liquid crystal layer 24, and the upper plate 23. At the applied test voltage, $V_1$, the liquid crystal layer 24 (in cooperation with polarizing filters on either side thereof; not shown, but conceptually forming part of the upper and lower plates 23, 25) passes substantially all of the backlight, such that the photosensor 32 detects only a very little amount of light. Referring to FIG. 4B, the applied test voltage, $V_2$, is different than $V_1$, such that the liquid crystal layer 24 (in cooperation with polarizing filters on either side thereof; not shown) reflects most of the backlight, such that the photosensor detects a significant amount of the backlight.

Figures 5, 6:
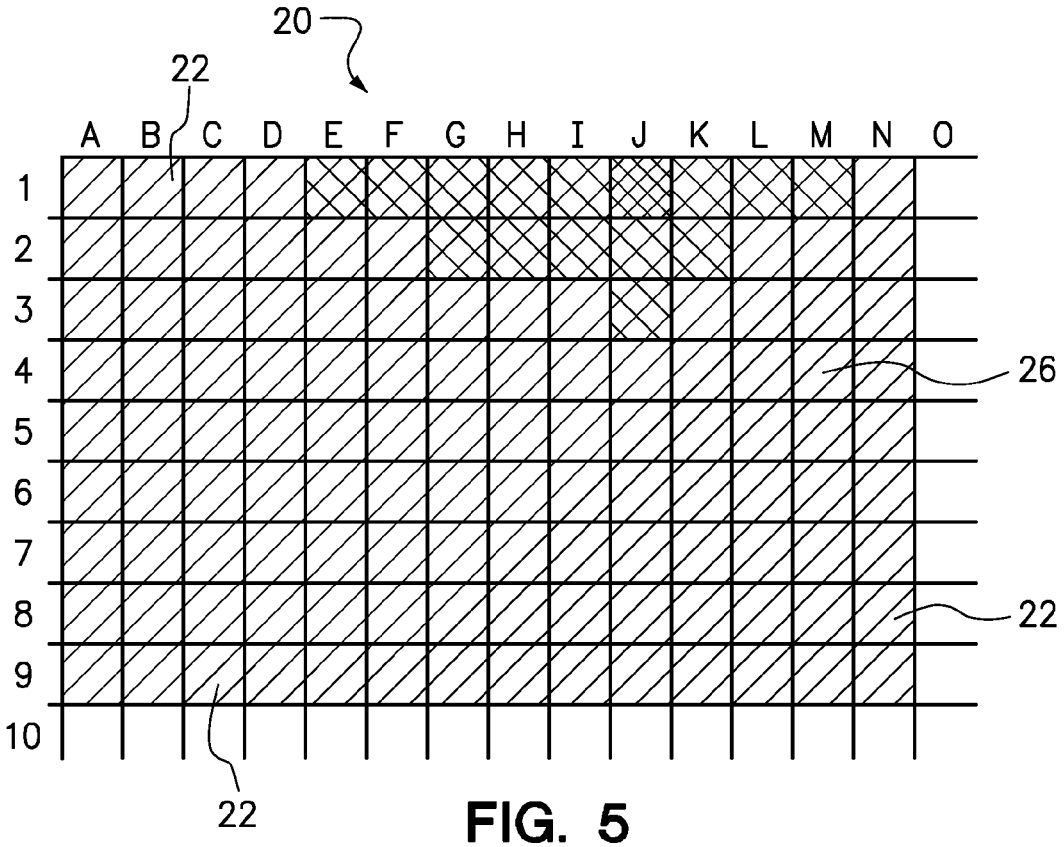
FIG. 5 is a plan view of a portion of a liquid crystal display including an array of addressable liquid crystal elements.
FIG. 6 is a hypothetical backlight compensation table prepared as a result of testing the liquid crystal elements of the liquid crystal display in FIG. 5.

FIG. 5 is a plan view of a portion of the liquid crystal display 20 including an array of addressable liquid crystal elements 22. The array 20 includes columns, for example labeled with alphabetic characters, and rows, for example labeled with integers. Each individual LCD element 22 may be uniquely identified by an address that is the combination of the column and row. For example, the LCD element at point 26 is identified by or located at address M4.

As shown, the LCD elements 22 are each receiving the same applied test voltage, yet those LCD elements along the upper edge of the display 20 are darker (passing less light) than the majority of the LCD elements in the display. This may be due to some persistent image or other mechanism for causing damage to these LCD elements.

FIG. 6 is a hypothetical backlight compensation table 90 prepared as a result of testing the liquid crystal elements of the liquid crystal display 20 in FIG. 5. While most of the liquid crystal elements 22 shown are normal, in that they all pass about the same amount of light under the test voltage, those LCD elements 22 near the upper edge are significantly darker and pass less light under the same applied test voltage. Accordingly, the amount of light detected by the photosensors (see photosensors 32 in FIG. 1) is used as input to control the amount of backlighting produced by the backlighting elements (see backlighting elements 42 in FIG. 1). The backlighting elements logically associated with (aligned with, or having the same address as) the darker LCD elements in FIG. 5 will therefore provide backlight compensation so that the darker LCD elements will appear about the same as the normal LCD elements. For the example display shown in FIG. 5, the backlight compensation table 90 in FIG. 6 shows that the backlighting elements logically associated with LCD elements E1, F1, G1, G2, H1, H2, I1, 12, J2, J3, K1, K2, L1 and M1 will be compensated by increasing the backlight (for example by 10%) and the backlighting elements logically associated with LCD element J1 will be compensated by increasing the backlight (for example by 20%). The amount of compensation may be calculated in various manners.

Figure 7:
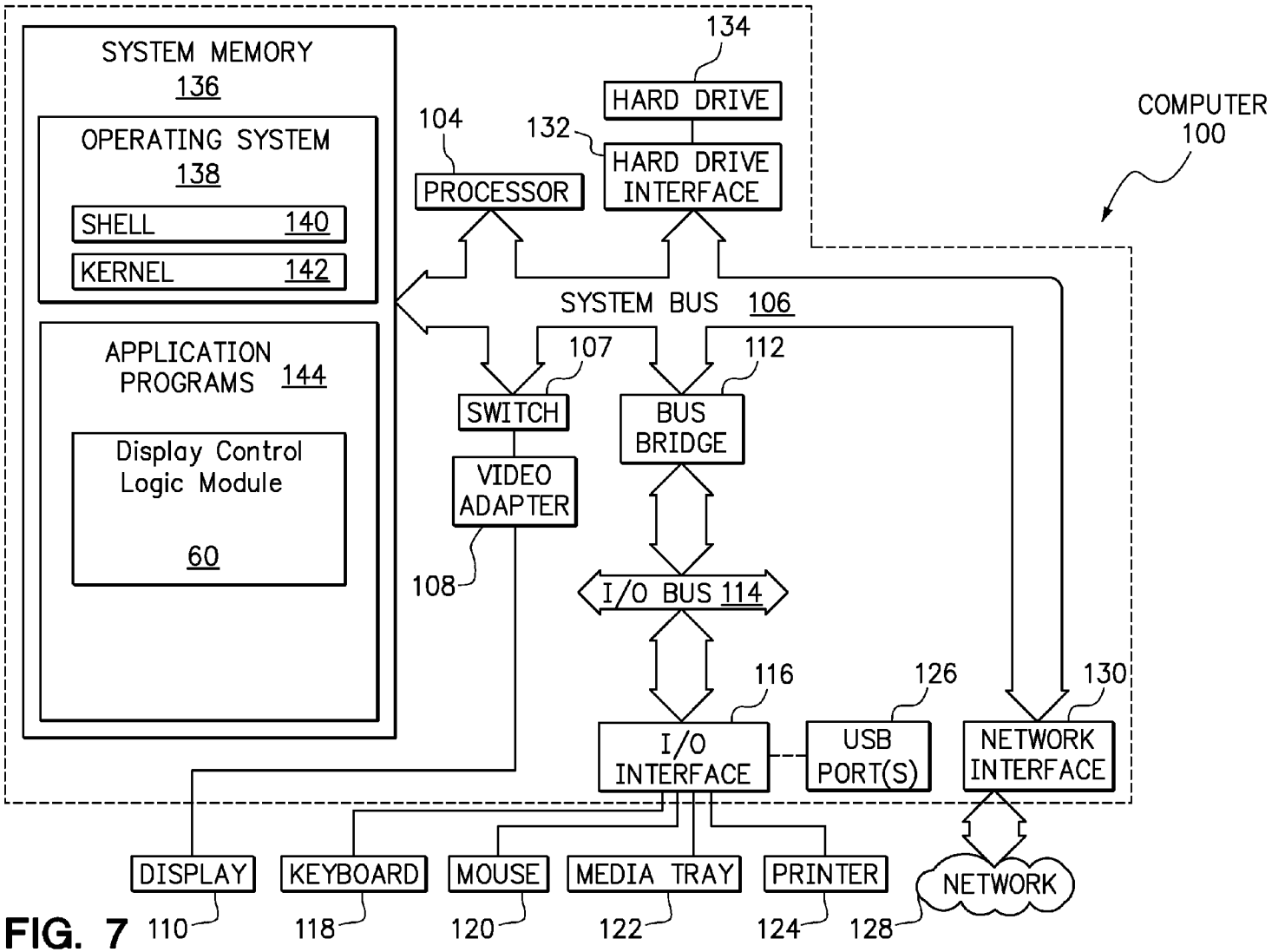
FIG. 7 is a diagram of a non-limiting example of a computer that may be used as a display controller in accordance with one embodiment of the invention.

FIG. 7 is a diagram of a non-limiting example of a computer 100 that may be used as a display controller 50 in accordance with one embodiment of the invention. Computer 100 includes a processor unit 104 that is coupled to a system bus 106. Processor unit 104 may utilize one or more processors, each of which has one or more processor cores. A video adapter 108, which drives/supports a display 110, is also coupled to system bus 106. In one embodiment, a switch 107 couples the video adapter 108 to the system bus 106. Alternatively, the switch 107 may couple the video adapter 108 to the display 110. In either embodiment, the switch 107 is a switch, preferably mechanical, that allows the display 110 to be coupled to the system bus 106, and thus to be functional only upon execution of instructions that support the processes described herein.

System bus 106 is coupled via a bus bridge 112 to an input/output (I/O) bus 114. An I/O interface 116 is coupled to I/O bus 114. I/O interface 116 affords communication with various I/O devices, including a keyboard 118, a mouse 120, a media tray 122 (which may include storage devices such as CD-ROM drives, multi-media interfaces, etc.), a printer 124, and (if a VHDL chip 137 is not utilized in a manner described below), external USB port(s) 126. While the format of the ports connected to I/O interface 116 may be any known to those skilled in the art of computer architecture, in a preferred embodiment some or all of these ports are universal serial bus (USB) ports.

As depicted, the computer 100 is able to communicate over a network 128 using a network interface 130. Network 128 may be an external network such as the Internet, or an internal network such as an Ethernet or a virtual private network (VPN).

A hard drive interface 132 is also coupled to system bus 106. Hard drive interface 132 interfaces with a hard drive 134. In a preferred embodiment, hard drive 134 populates a system memory 136, which is also coupled to system bus 106. System memory is defined as a lowest level of volatile memory in computer 100. This volatile memory includes additional higher levels of volatile memory (not shown), including, but not limited to, cache memory, registers and buffers. Data that populates system memory 136 includes computer 100's operating system (OS) 138 and application programs 144.

The operating system 138 includes a shell 140, for providing transparent user access to resources such as application programs 144. Generally, shell 140 is a program that provides an interpreter and an interface between the user and the operating system. More specifically, shell 140 executes commands that are entered into a command line user interface or from a file. Thus, shell 140, also called a command processor, is generally the highest level of the operating system software hierarchy and serves as a command interpreter. The shell provides a system prompt, interprets commands entered by keyboard, mouse, or other user input media, and sends the interpreted command(s) to the appropriate lower levels of the operating system (e.g., a kernel 142) for processing. Note that while shell 140 is a text-based, line-oriented user interface, the present invention will equally well support other user interface modes, such as graphical, voice, gestural, etc.

As depicted, OS 138 also includes kernel 142, which includes lower levels of functionality for OS 138, including providing essential services required by other parts of OS 138 and application programs 144, including memory management, process and task management, disk management, and mouse and keyboard management. Application programs 144 in the system memory of computer 100 may include a display control logic module 62 for implementing the methods described herein. The pixel performance data, including damaged pixel data 72 (See FIG. 1), may be saved on the hard disk drive 134, the input/output ports 52, 54, 56 may be supported by the I/O interface 116, and the LCD display 20 (See FIG. 1) may be the display 110.

The hardware elements depicted in computer 100 are not intended to be exhaustive, but rather are representative components suitable to perform the processes of the present invention. For instance, computer 100 may include alternate memory storage devices such as magnetic cassettes, digital versatile disks (DVDs), Bernoulli cartridges, and the like. These and other variations are intended to be within the spirit and scope of the present invention.

Figure 8:
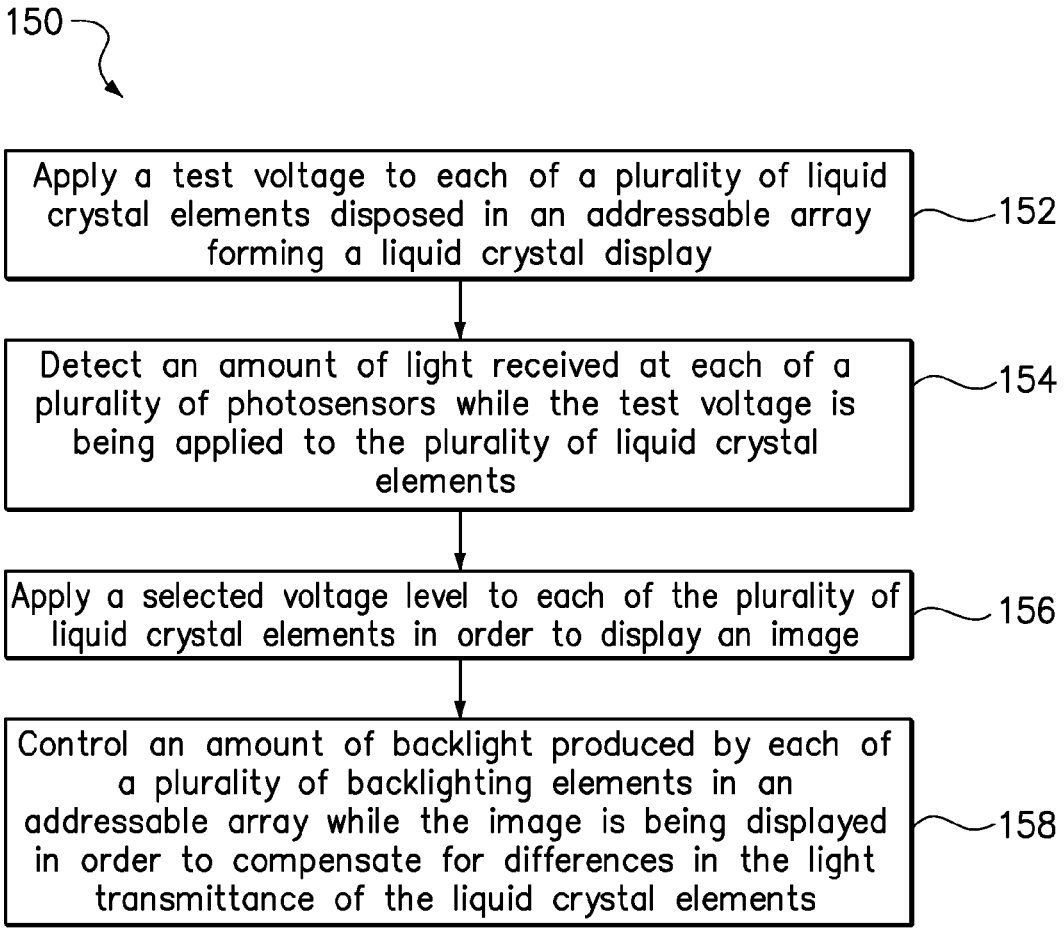
FIG. 8 is a flowchart of a method of controlling a liquid crystal display.

FIG. 8 is a flowchart of a method 150 of controlling a liquid crystal display. In step 152, a test voltage is applied to each of a plurality of liquid crystal elements disposed in an addressable array forming the liquid crystal display. In step 154, an amount of light received at each of a plurality of photosensors is detected while the test voltage is being applied to the plurality of liquid crystal elements. Selected voltage levels are applied to each of the plurality of liquid crystal elements, in step 156, in order to display an image. Step 158 includes controlling an amount of backlight produced by each of a plurality of backlighting elements in an addressable array, while the image is being displayed, in order to compensate for differences in the light transmittance of the liquid crystal elements. In one embodiment, the amount of backlight produced by the backlighting elements logically associated with the at least one of the liquid crystal elements is controlled to compensate for a difference between the amount of light detected by the photosensor logically associated with the at least one of the liquid crystal elements and the amount of light detected by other photosensors of the plurality of photosensors.

The first two steps 152, 154 of the method 150 may be referred to as a "pixel detect mode" or simply a "test mode." By contrast, the second two steps 156, 158 of the method 150 may be referred to as an "operational mode." The data acquired in the test mode is used to improve the appearance of the LCD display in the operational mode.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention may be described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, and/or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A computer program product including computer usable program code embodied on a non-transitory computer readable storage medium for controlling a liquid crystal display, the computer program product including:

computer usable program code for applying a test voltage to each of a plurality of liquid crystal elements disposed in an addressable array forming the liquid crystal display;

computer usable program code for detecting an amount of light received at each of a plurality of photosensors while the test voltage is being applied to the plurality of liquid crystal elements, wherein each one of the photosensors is aligned behind one of the liquid crystal elements receiving the test voltage and is logically associated with the aligned liquid crystal element;

computer usable program code for applying selected voltage levels to each of the plurality of liquid crystal elements in order to display an image; and computer usable program code for controlling an amount of backlight produced by each of a plurality of backlighting elements in an addressable array while the image is being displayed, wherein each of the backlighting elements is aligned behind one of the liquid crystal elements and is logically associated with the aligned liquid crystal element, and wherein, for at least one of the liquid crystal elements, the amount of backlight produced by the backlighting elements logically associated with the at least one of the liquid crystal elements is controlled to compensate for a difference between the amount of light detected by the photosensor logically associated with the at least one of the liquid crystal elements and the amount of light detected by other photosensors of the plurality of photosensors.

2. The computer program product of claim 1, further comprising:

computer readable program code for controlling the backlighting elements logically associated with the at least one of the liquid crystal elements to produce less backlight while the image is displayed in response to the amount of ambient light detected by the photosensor logically associated with the at least one of the liquid crystal elements being greater than the amount of light detected by other photosensors of the plurality of photosensors while the test voltage is being applied.

3. The computer program product of claim 1, further comprising:

computer readable program code for controlling the backlighting elements logically associated with the at least one of the liquid crystal elements to produce more backlight while the image is displayed in response to the amount of ambient light detected by the photosensor logically associated with the at least one of the liquid crystal elements being less than the amount of light detected by other photosensors of the plurality of photosensors while the test voltage is being applied.

4. The computer program product of claim 1, further comprising:

computer readable program code for controlling the backlighting elements logically associated with the at least one of the liquid crystal elements to produce more backlight while the image is displayed in response to the amount of reflected light detected by the photosensor logically associated with the at least one of the liquid crystal elements being greater than the amount of light detected by other photosensors of the plurality of photosensors while the test voltage is being applied.

5. The computer program product of claim 1, further comprising:

computer readable program code for controlling the backlighting elements logically associated with the at least one of the liquid crystal elements to produce less backlight while the image is displayed in response to the amount of reflected light detected by the photosensor logically associated with the at least one of the liquid crystal elements being less than the amount of light detected by other photosensors of the plurality of photosensors while the test voltage is being applied.

6. The computer program product of claim 1, wherein the computer usable program code for controlling an amount of backlight produced by each of a plurality of backlighting elements while the image is being displayed will compensate for a difference between the amount of light detected by the photosensor logically associated with the at least one of the liquid crystal elements and the amount of light detected by other photosensors of the plurality of photosensors only if the difference exceeds a predetermined setpoint.

7. The computer program product of claim 1, further comprising:

computer readable program code for periodically repeating the steps of:

applying a test voltage to each of a plurality of liquid crystal elements disposed in an addressable array forming the liquid crystal display; and detecting an amount of light received at each of a plurality of photosensors while the test voltage is being applied to the plurality of liquid crystal elements.

8. A method of controlling a liquid crystal display, comprising:

applying a test voltage to each of a plurality of liquid crystal elements disposed in an addressable array forming the liquid crystal display;

detecting an amount of light received at each of a plurality of photosensors while the test voltage is being applied to the plurality of liquid crystal elements, wherein each one of the photosensors is aligned behind one of the liquid crystal elements receiving the test voltage and is logically associated with the aligned liquid crystal element;

applying selected voltage levels to each of the plurality of liquid crystal elements in order to display an image; and controlling an amount of backlight produced by each of a plurality of backlighting elements in an addressable array while the image is being displayed, wherein each of the backlighting elements is aligned behind one of the liquid crystal elements and is logically associated with the aligned liquid crystal element, and wherein, for at least one of the liquid crystal elements, the amount of backlight produced by the backlighting elements logically associated with the at least one of the liquid crystal elements is controlled to compensate for a difference between the amount of light detected by the photosensor logically associated with the at least one of the liquid crystal elements and the amount of light detected by other photosensors of the plurality of photosensors.

9. The method of claim 8, wherein the light received at each of a plurality of photosensors while the test voltage is being applied to the plurality of liquid crystal elements is ambient light, and wherein the ambient light passes through the plurality of liquid crystal elements to the plurality of photosensors.

10. The method of claim 9, wherein the backlighting elements logically associated with the at least one of the liquid crystal elements are controlled to produce less backlight in response to the amount of light detected by the photosensor logically associated with the at least one of the liquid crystal elements being greater than the amount of light detected by other photosensors of the plurality of photosensors.

11. The method of claim 9, wherein the backlighting elements logically associated with the at least one of the liquid crystal elements are controlled to produce more backlight in response to the amount of light detected by the photosensor logically associated with the at least one of the liquid crystal elements being less than the amount of light detected by other photosensors of the plurality of photosensors.

12. The method of claim 8, wherein the light received at each of a plurality of photosensors while the test voltage is being applied to the plurality of liquid crystal elements is light produced by the plurality of backlighting elements controlled to produce an equal amount of light, wherein the light produced by the plurality of backlighting elements is reflected off the plurality of liquid crystal elements to the plurality of photosensors.

13. The method of claim 12, wherein the backlighting elements logically associated with the at least one of the liquid crystal elements are controlled to produce more backlight in response to the amount of light detected by the photosensor logically associated with the at least one of the liquid crystal elements being greater than the amount of light detected by other photosensors of the plurality of photosensors.

14. The method of claim 12, wherein the backlighting elements logically associated with the at least one of the liquid crystal elements are controlled to produce less backlight in response to the amount of light detected by the photosensor logically associated with the at least one of the liquid crystal elements being less than the amount of light detected by other photosensors of the plurality of photosensors.

15. The method of claim 8, wherein the test voltage is a single fixed voltage.

16. The method of claim 15, wherein single fixed voltage is selected from no voltage and a maximum voltage.

17. The method of claim 8, wherein the photosensors are thin film transistors.

18. The method of claim 8, wherein the backlighting elements are light emitting diodes.

19. The method of claim 8, further comprising: periodically repeating the steps of:

applying a test voltage to each of a plurality of liquid crystal elements disposed in an addressable array forming the liquid crystal display; and detecting an amount of light received at each of a plurality of photosensors while the test voltage is being applied to the plurality of liquid crystal elements.

20. The method of claim 8, wherein the amount of backlight produced by the backlighting elements is controlled to compensate for a difference between the amount of light detected by the photosensor logically associated with the at least one of the liquid crystal elements and the amount of light detected by other photosensors of the plurality of photosensors only if the difference exceeds a predetermined setpoint.

* * * * *